US007971363B2

(12) United States Patent
Nakasuka

(10) Patent No.: US 7,971,363 B2
(45) Date of Patent: Jul. 5, 2011

(54) OSCILLATING RAZOR

(75) Inventor: Hiroyuki Nakasuka, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 643 days.

(21) Appl. No.: 11/991,244

(22) PCT Filed: Aug. 29, 2006

(86) PCT No.: PCT/JP2006/316914

§ 371 (c)(1),
(2), (4) Date: Feb. 29, 2008

(87) PCT Pub. No.: WO2007/029552

PCT Pub. Date: Mar. 15, 2007

(65) Prior Publication Data

US 2009/0260238 A1 Oct. 22, 2009

(30) Foreign Application Priority Data

Sep. 9, 2005 (JP) ..... P2005-262483

(51) Int. Cl.
*B26B 21/52* (2006.01)

(52) U.S. Cl. ..... 30/532; 30/527; 30/533

(58) Field of Classification Search ..... 30/527, 30/530, 532, 533
See application file for complete search history.

(56) References Cited

U.S. PATENT DOCUMENTS 1,491,596 A * 4/1924 Everett ..... 30/49
4,198,746 A * 4/1980 Trotta ..... 30/47
4,253,235 A * 3/1981 Jacobson ..... 30/47
4,266,340 A * 5/1981 Bowman ..... 30/532
4,514,904 A * 5/1985 Bond ..... 30/530
4,658,505 A * 4/1987 Williams ..... 30/47
4,739,553 A * 4/1988 Lazarchik ..... 30/47
4,756,082 A * 7/1988 Apprille, Jr. ..... 30/530

(Continued)

FOREIGN PATENT DOCUMENTS

JP P55-28717 7/1980

(Continued)

OTHER PUBLICATIONS

International Search Report dated Nov. 27, 2006 in corresponding International Application No. PCT/JP2006/316914.

(Continued)

*Primary Examiner* — Hwei-Siu C Payer
(74) *Attorney, Agent, or Firm* — Posz Law Group, PLC

(57) ABSTRACT

A head portion of a holder incorporates a pair of support arms, which oscillatably support a razor head, and a pusher, which is pressed against the razor head. The razor head includes a blade body with a cutting edge. The razor head is supported by the support arms at both ends in the extending direction of the cutting edge of the blade body. The razor head includes a pair of supported portions and a pair of contact portions. The support arms include first outer arm portions, which support the supported portions such that the razor head is rotatable in an oscillating direction. The pusher includes a pair of second outer arm portions formed on both ends in the extending direction of the cutting edge of the blade body. The second outer arm portions are pressed against the contact portions. At least part of each second outer arm portion is arranged in a region extending through the associated first outer arm portions in a direction perpendicular to a plane containing a contact direction of the pusher.

8 Claims, 4 Drawing Sheets

U.S. PATENT DOCUMENTS

| | | | | |
|---|---|---|---|---|
| 4,797,998 | A * | 1/1989 | Motta | 30/530 |
| 5,016,352 | A * | 5/1991 | Metcalf | 30/532 |
| 6,115,924 | A * | 9/2000 | Oldroyd | 30/527 |
| 6,311,400 | B1 * | 11/2001 | Hawes et al. | 30/527 |
| 6,612,040 | B2 * | 9/2003 | Gilder | 30/530 |
| 6,854,188 | B1 * | 2/2005 | Wonderley | 30/532 |
| 6,880,253 | B1 * | 4/2005 | Gyllerstrom | 30/527 |
| 7,200,942 | B2 * | 4/2007 | Richard | 30/526 |
| 7,574,809 | B2 * | 8/2009 | Follo et al. | 30/527 |
| 7,685,720 | B2 * | 3/2010 | Efthimiadis et al. | 30/527 |
| 2009/0260238 | A1 * | 10/2009 | Nakasuka | 30/527 |

FOREIGN PATENT DOCUMENTS

| | | |
|---|---|---|
| JP | P59-103692 | 6/1984 |
| JP | P60-13711 | 4/1985 |
| JP | P60-90585 | 5/1985 |
| JP | P60-90586 | 5/1985 |
| JP | P60-90587 | 5/1985 |
| JP | P60-103987 | 6/1985 |
| JP | P7-501252 | 9/1995 |
| JP | P2005-218646 | 8/2005 |
| WO | WO 93/10947 | 6/1996 |

OTHER PUBLICATIONS

Notification of Transmittal of Translation of the International Preliminary Report on Patentability dated Mar. 20, 2008 in corresponding PCT Application No. PCT/JP2006/316914.

* cited by examiner

W9
W11
14a
11b
9
7
4
3
2
12
13
5
6
8
10
11
11a
14
15
P
X
Y
S
H1
H2
15a
Z

OSCILLATING RAZOR

CROSS REFERENCE TO RELATED APPLICATIONS

This application is a U.S. national stage application of PCT/JP2006/316914 filed on Aug. 29, 2006, which is based on Japanese Patent Application No. 2005-262483 filed on Sep. 9, 2005, the disclosures of which are incorporated herein by reference.

This application is related to U.S. application Ser. No. 11/991,269 entitled RAZOR, filed on Feb. 29, 2008, which is a U.S. national stage application of PCT Application No. PCT/JP2006/316915 filed on Aug. 29, 2006.

FIELD OF THE INVENTION

The present invention relates to an oscillating razor including support arms, which oscillatably support a razor head having a blade body, and a pusher, which is pressed against the razor head, and to an improvement in the positional relationship between the support arms and the pusher.

BACKGROUND OF THE INVENTION

An oscillating razor according to the following Patent Document 1 includes a razor head having a blade body, support arms, and a pusher. The razor head includes supported portions and contact portions. The support arms include first distal end portions, which support the supported portions of the razor head. The pusher includes second distal end portions, which are pressed against the contact portions of the razor head.

However, in the following Patent Document 1, the first distal end portions of the support arms and the second distal end portions of the pusher are arranged in the same plane to be adjacent to one another along the extending direction of the cutting edge of the blade body. Thus, a space defined along the extending direction of the cutting edge of the blade body is narrow between parts of the razor head where the supported portions and the contact portions are formed and between the first and second distal end portions. This hinders the flow of a shaving aid, water, and cut objects that pass through the space.

Patent Document 1: Japanese Examined Patent Publication No. 55-28717

SUMMARY OF THE INVENTION

Accordingly, it is an objective of the present invention to increase a space that is defined along an extending direction of a cutting edge of a blade body and between parts of a razor head where supported portions and contact portions are formed, and between the support arms and the distal end portions of the pusher, thereby improving the flow of a shaving aid, water, cut objects that pass through the space.

One aspect of the present invention provides an oscillating razor including a razor head, a support arm, and a pusher. The razor head includes a blade body with a cutting edge. The support arm oscillatably supports the razor head. The pusher is pressed against the razor head. The oscillating razor includes a supported portion and a contact portion formed in the razor head, a first distal end portion, and a second distal end portion. The first distal end portion is formed on the support arm and supports the supported portion of the razor head. The second distal end portion is formed on the pusher and is pressed against the contact portion of the razor head.

The first distal end portion and the second distal end portion are arranged along a direction perpendicular to a plane containing a contact direction of the pusher.

With this configuration, a space defined along an extending direction of the cutting edge of the blade body is increased between parts of the razor head where the supported portion and the contact portion are formed, and between the first distal end portion of the support arm and the second distal end portion of the pusher.

Another aspect of the present invention provides an oscillating razor including a holder having a head portion, a razor head arranged on the head portion, a pair of support arms arranged in the head portion, and a pusher arranged in the head portion. The razor head includes a blade body with a cutting edge. The pair of support arms oscillatably support the razor head on both ends in the extending direction of the cutting edge of the blade body. The pusher is pressed against the razor head. The oscillating razor includes a pair of supported portions and a pair of contact portions formed in the razor head, first distal end portions formed on the pair of support arms, and a pair of second distal end portions formed on the pusher at positions corresponding to both ends in the extending direction. Of the cutting edge of the blade body The first distal end portions support the supported portions such that the razor head is rotatable along an oscillating direction. The second distal end portions are pressed against the contact portions. At least part of each second distal end portion is arranged in a region extending through the associated first distal end portion in a direction perpendicular to a plane containing a contact direction of the pusher.

With this configuration, a space defined along the extending direction of the cutting edge of the blade body is increased between parts of the razor head where the supported portions and the contact portions are formed, and between the first distal end portions of the supported arms and the second distal end portions of the pusher at the head portion of the holder. Also, the second distal end portions of the pusher are pressed against the razor head in the vicinity of the first distal end portions of the support arms, which oscillatably support the razor head. Thus, compared to a case where the second distal end portions of the pusher are pressed against the razor head at the central part between the first distal end portions of the support arms, the razor head is prevented from being deformed even if the razor head is thin.

Preferably, the first distal end portions and the second distal end portions are arranged outward of the head portion of the holder, and are arranged next to each other at each end in the extending direction of the cutting edge of the blade body. In this case, a gap is defined between the first and second distal end portions located at one of the ends in the extending direction of the cutting edge of the blade body and the first and second distal end portions located at the other end in the extending direction of the cutting edge of the blade body. With this configuration, the space along the extending direction of the cutting edge of the blade body is increased between the distal end portions located at one of the ends and the distal end portions located at the other one of the ends. The user of the oscillating razor can use the oscillating razor while looking at the surface of the skin through the space.

Preferably, the oscillating razor includes a pair of openings formed in the head portion of the holder, a first outer arm portion formed in each of the support arms, and a pair of second outer arm portions formed in the pusher. In this case, the first outer arm portions protrude outward from the openings and configure the first distal end portions. The second outer arm portions protrude outward from the openings and configure the second distal end portions. The support arms selectively open and close with respect to each other in the head portion of the holder. The pusher is movable in the head portion of the holder. According to this configuration, the oscillating razor, in which the support arms and the pusher are located in the head portion of the holder, provides the above advantages.

Preferably, each of the first outer arm portions and the associated second outer arm portion are arranged next to each other in a common one of the opening. With this configuration, the space along the extending direction of the cutting edge of the blade body is further increased.

Preferably, at each end of the razor head in the extending direction of the cutting edge of the blade body, the supported portion, which is supported by the associated first distal end portion, and the contact portion, to which the associated second distal end portion is pressed against, are arranged adjacent to each other. For example, the supported portions and the contact portions are formed in recesses formed in the razor head. With this configuration, the structure of part of the razor head where the supported portions and the contact portions are formed is simplified.

Preferably, the second distal end portions are slidable with respect to the first distal end portions. With this configuration, since the second distal end portions are supported by the first distal end portions, the movement of the pusher is stabilized.

Preferably, the oscillating razor includes an assembly member arranged in the razor head. The assembly member includes a guard. In this case, the blade body is mounted on the assembly member. The cutting edge of the blade body faces the guard. The second distal end portions of the pusher are arranged over the first distal end portions of the support arms in a direction perpendicular to a plane containing the contact direction of the pusher. That is, the second distal end portions of the pusher are arranged further from the guard than the first distal end portions of the support arms. With this configuration, a space is defined between the first distal end portions of the support arms and the guard.

Preferably, the support arms are selectively arranged at a support position, at which the support arms support the razor head, and a standby position, at which the support arms stand ready to support the razor head. In this case, when the support arms are at the standby position, the end portion of the first outer arm portion of each support arm protrudes from the end portion of the associated second outer arm portion of the pusher in the contact direction of the pusher. With this configuration, when the support arms move from the standby position to the support position, the end portions of the first outer arm portions of the support arms are easily seen, which facilitates the user to make the end portions to be supported by the supported portions of the razor head.

BRIEF DESCRIPTION OF THE DRAWINGS

FIG. 1(*b*) is a perspective view illustrating the oscillating razor as viewed from the front side;

FIG. 2(*b*) is a side view illustrating the head portion of the holder;

Fig. 2(*c*) is a cross-sectional view illustrating the head portion of the holder;

FIG. 2(*d*) is a plan view illustrating the head portion of the holder when the support arms are arranged at a standby position;

FIG. 3(*b*) is a back view illustrating the razor head and the shaving aid member;

FIG. 4(*b*) is a side view illustrating a state where the shaving aid member is arranged at a rotated position;

FIGS. 5(*b*) and 5(*c*) are cross-sectional views illustrating part of the support structure and the contact structure.

DESCRIPTION OF THE PREFERRED EMBODIMENTS

Figure 1:
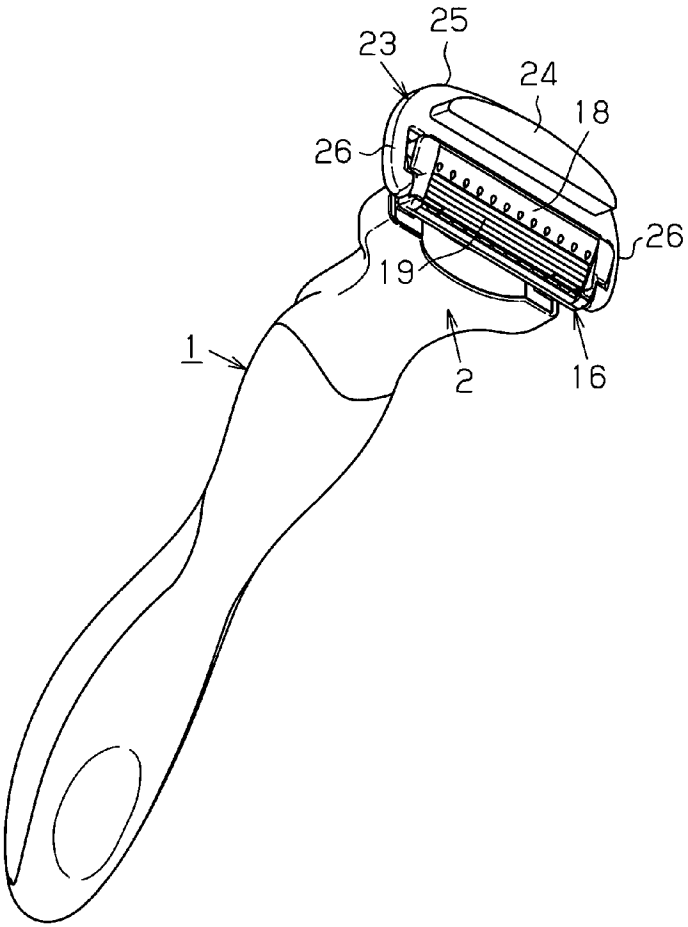
FIG. 1(*a*) is a perspective view illustrating an oscillating razor according to a preferred embodiment as viewed from the back side.
Figure 1:
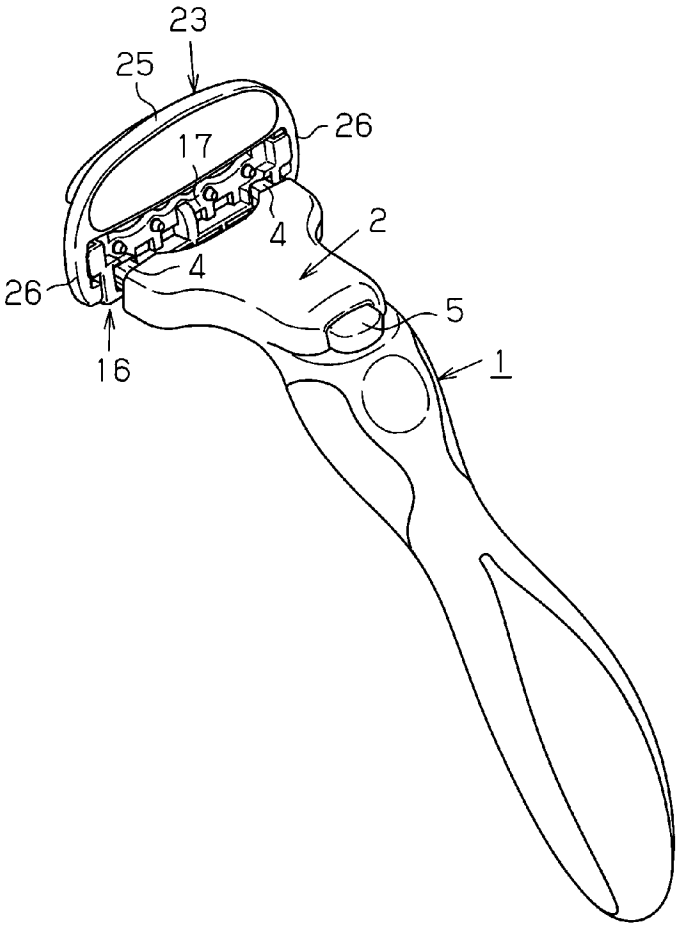

An oscillating razor according to one embodiment of the present invention will now be described with reference to drawings. As shown in FIGS. 1(*a*), 1(*b*), and 2(*a*) to 2(*c*), a head portion 2 of a holder 1 incorporates a pair of metal support arms 3, a bifurcated plastic pusher 4, a plastic operating knob 5, and a metal compression coil spring 6. An opening 7 is formed at each end of the head portion 2 (each end of the head portion 2 in the Y-axis direction in FIG. 2(*c*)). The holder 1 is molded out of plastic. The support arms 3 are supported at their proximal ends to swing about a support shaft 8 of the head portion 2. As a result, the support arms 3 are movable in the Y-axis direction. Each support arm 3 includes a first outer arm portion 9, which extends from the proximal end toward the front end of the head portion 2 and protrudes outward from the corresponding opening 7 of the head portion 2. The first outer arm portions 9 configure first distal end portions of the support arms 3.

The pusher 4 is arranged between the support arms 3 in the vicinity of the front end of the head portion 2. The pusher 4 is supported at its proximal end to be movable in the front-back direction with respect to the head portion 2 (X-axis direction in FIG. 2 (*c*)). The pusher 4 includes a pair of inner arm portions 10, which extend from its proximal end toward the support arms 3. Furthermore, the pusher 4 includes a pair of second outer arm portions 11, which extend from the inner arm portions 10 toward the front end of the head portion 2 and protrude outward from the openings 7 of the head portion 2. The second outer arm portions 11 configure a pair of second distal end portions of the pusher 4.

The operating knob 5 is supported at the rear of the head portion 2 to be movable in the X-axis direction, and protrudes outward from the rear end of the head portion 2. An elastic body, which is the compression coil spring 6 in this embodiment, is located between the proximal end of the pusher 4 and the operating knob 5. The compression coil spring 6 urges the proximal end of the pusher 4 forward so that the pusher 4 is pressed against the front end of the head portion 2 while urging the operating knob 5 rearward to protrude outward. Furthermore, the compression coil spring 6 urges the support arms 3 through the operating knob 5 so that the first outer arm portions 9 of the support arms 3 are arranged at the support position shown in FIGS. 2(*a*) and 2(*c*).

Figures 2A, 2B, 2C, 2D:
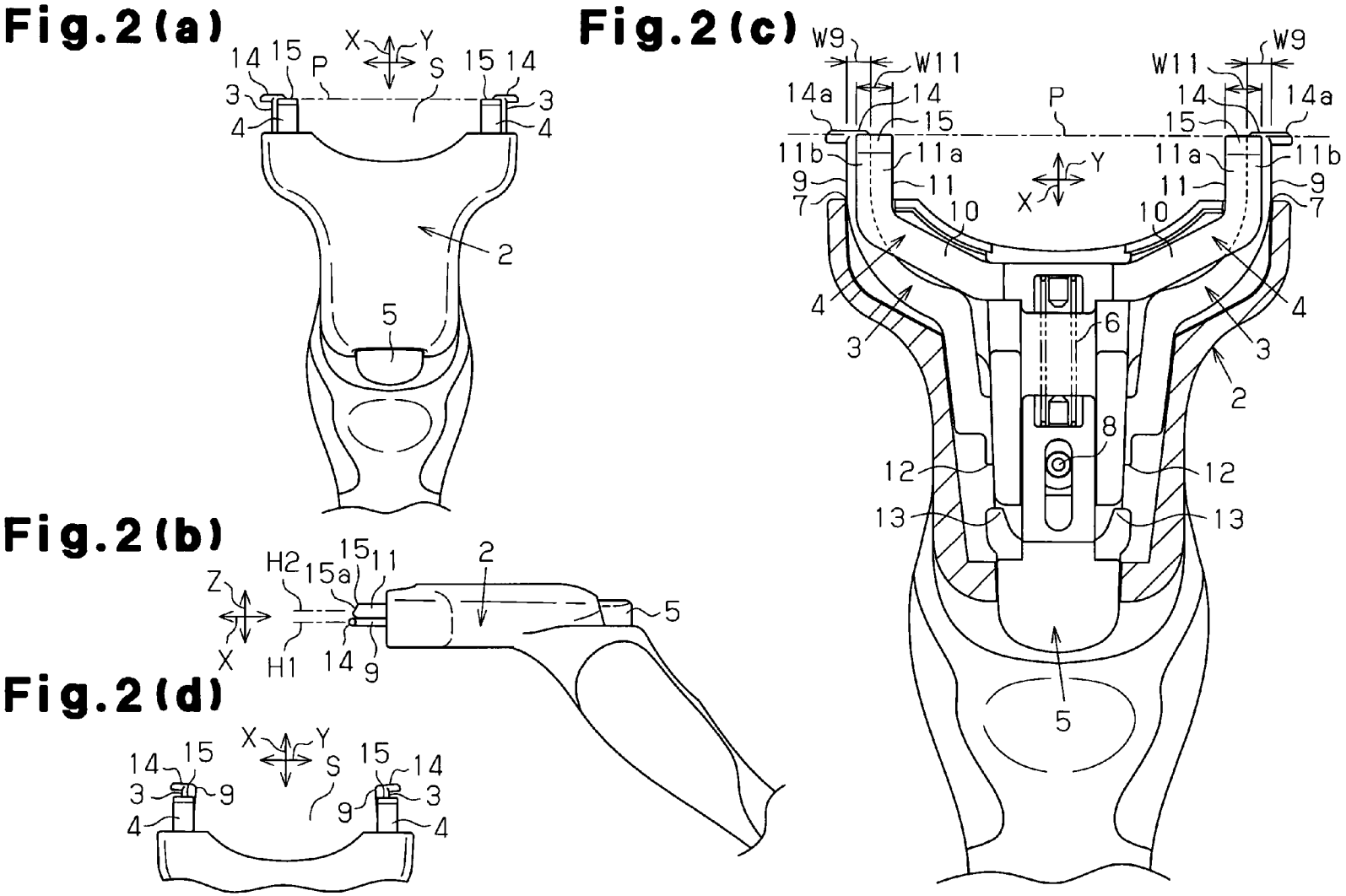
FIG. 2(*a*) is a plan view illustrating a head portion of a holder when support arms are arranged at a support position.
Figure 3A:
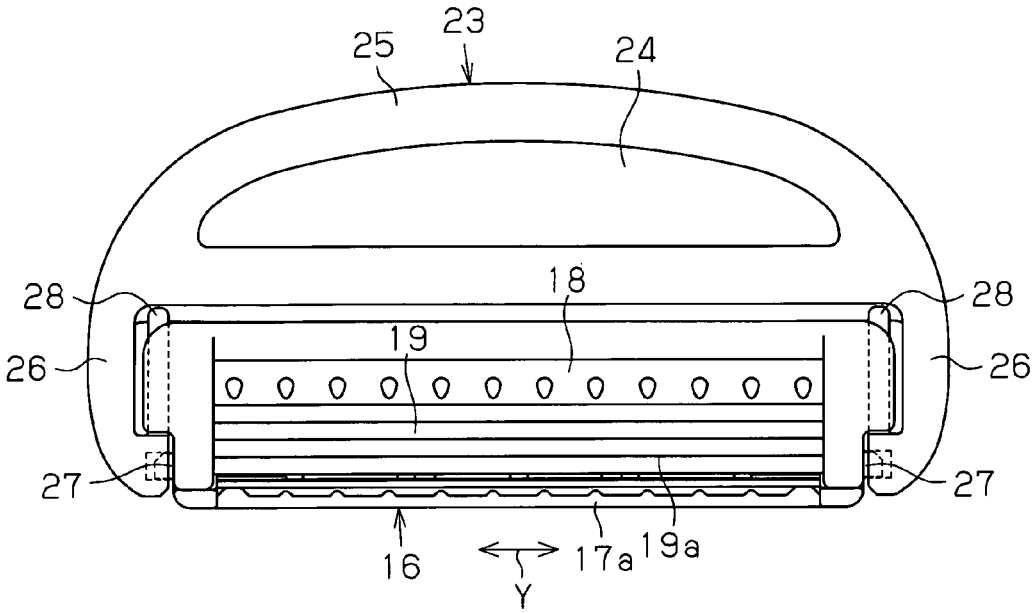
FIG. 3(*a*) is a front view illustrating a razor head and a shaving aid member.
Figure 3B:
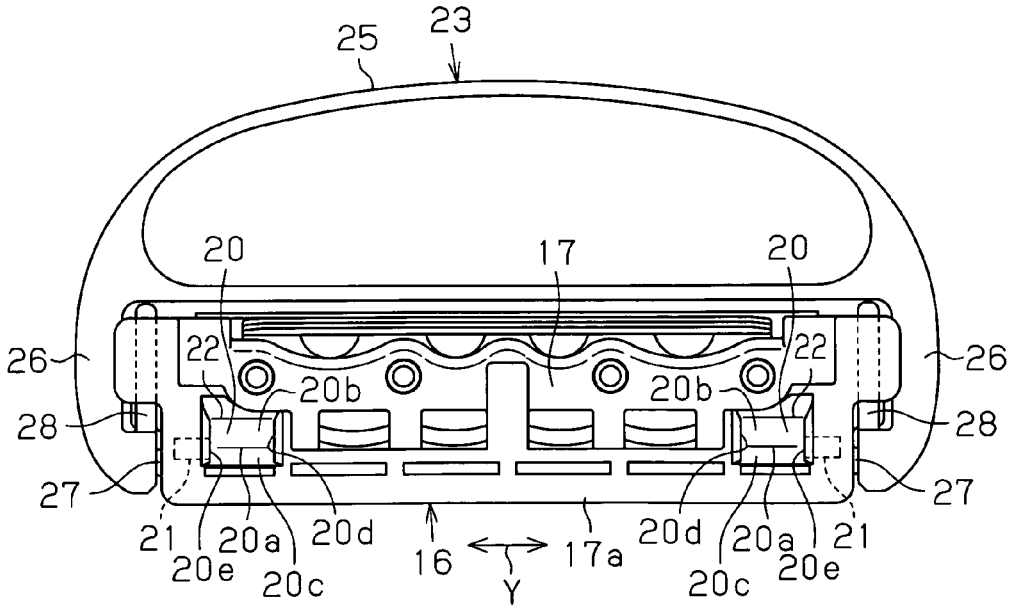

An abutment portion 12 is formed at the proximal end of each support arm 3. The operating knob 5 includes a depression portion 13 on either end in the Y-axis direction. Each depression portion 13 faces one of the abutment portion 12. For example, when a user of the oscillating razor presses, with a finger, the operating knob 5 forward against the elastic force of the compression coil spring 6, the depression portions 13 of the operating knob 5 press the abutment portions 12 of the support arms 3 so that the first outer arm portions 9 of the support arms 3 approach each other as shown in FIG. 2(*d*). That is, the first outer arm portions 9 of the support arms 3 move from a support position to a standby position. Then, when the user removes the finger from the operating knob 5, the operating knob 5 returns to the original position, and the first outer arm portions 9 of the support arms 3 return to the support position.

Each of the first outer arm portions 9 of the support arms 3 includes a hooked end portion 14. A pair of the hooked end portions 14 each include a shaft portion 14*a*. The shaft portions 14*a* extend in the Y-axis direction and protrude from the distal ends of the first outer arm portions 9 in opposite directions from each other. The second outer arm portions 11 of the pusher 4 include contact end portions 15. The contact end portions 15 include contact surfaces 15*a*, which tilt rearward as they extend upward. The contact surface 15*a* of each contact end portion 15 is located in the vicinity of a rotational axis P, which extends through the shaft portions 14*a* of the hooked end portions 14. The first outer arm portion 9 of each support arm 3 and the corresponding second outer arm portion 11 of the pusher 4 are arranged adjacent to each other on two planes H1 and H2, which include the contact direction of the pusher 4, which is the X-axis direction in this embodiment, at a position outward of the corresponding opening 7 of the head portion 2 of the holder 1 and the front end of the head portion 2. That is, the first outer arm portion 9 of each support arm 3 and the corresponding second outer arm portion 11 of the pusher 4 are arranged adjacent to each other along the vertical direction (Z-axis direction in FIG. 2(*b*)), which is perpendicular to the plane H1, which includes the first outer arm portions 9 of the support arms 3, and the plane H2, which includes the second outer arm portions 11 of the pusher 4.

The second outer arm portions 11 of the pusher 4 are arranged over the first outer arm portions 9 of the support arms 3, and are slidable with respect to the first outer arm portions 9 while being in contact with the first outer arm portions 9. The width W11 of the second outer arm portions 11 of the pusher 4 in the Y-axis direction is greater than the width W9 of the first outer arm portions 9 of the support arms 3 in the Y-axis direction. For example, in the preferred embodiment, the width W11 is set to approximately 3 mm, and the width W9 is set to approximately 2 mm.

When the support arms 3 are arranged at the support position (position of the support arms 3 shown in FIGS. 2(*a*) and 2(*c*)) at which the support arms 3 support the razor head 16, parts 11*a* of the outer arm portions 11 of the pusher 4 are arranged out of regions that extend in the Z-axis direction through the first outer arm portions 9 of the support arms 3. Furthermore, remaining parts 11*b* of the outer arm portions 11 of the pusher 4 are arranged in the regions. The regions are, in other words, spaces defined by surfaces, which extend in the Z-axis direction through the edges of the first outer arm portions 9. The first outer arm portions 9 of the support arms 3 and the second outer arm portions 11 of the pusher 4 arranged in this manner protrude outward from the openings 7 while being arranged next to each other to reduce clearances in the common openings 7 so that dust is prevented from entering.

A gap S is defined between the first outer arm portions 9 of the support arms 3 and between the second outer arm portions 11 of the pusher 4 at an area outward of the front end of the head portion 2. The dimension of the gap S in the Y-axis direction is preferably 15 mm or more, and is, for example, approximately 28 mm in this embodiment.

When the first outer arm portions 9 of the support arms 3 are at the support position shown in FIGS. 2(*a*) and 2(*c*), the contact surfaces 15*a* of the contact end portions 15 are located in the vicinity of the rotational axis P, which extends through the shaft portions 14*a* of the hooked end portions 14 on the first outer arm portions 9 of the support arms 3. When the first outer arm portions 9 of the support arms 3 are in the standby position as shown in FIG. 2(*d*), the hooked end portions 14 protrude forward than the contact end portions 15 (upward in FIG. 2(*d*)).

As shown in FIGS. 1(*a*), 1(*b*), 3(*a*), and 3(*b*), the razor head 16 includes a blade base 17, which has a guard 17*a*, a top plate 18, which is arranged on the surface of the blade base 17, and blade bodies 19 (four in this embodiment), which are attached between the blade base 17 and the top plate 18. The blade base 17 and the top plate 18 configure an assembly member. The top plate 18 is exposed outward in a state where the blade bodies 19 are attached. Cutting edges 19*a* of the blade bodies 19 face the guard 17*a* and extend in the Y-axis direction. Recesses 20 are formed on the back side of the blade base 17. The recesses 20 are located at the end portions of the blade base 17 in the extending direction of the cutting edges 19*a* of the blade bodies 19, that is, at the end portions of the blade base 17 in the Y-axis direction, and adjacent to the guard 17*a*.

Figure 5A:
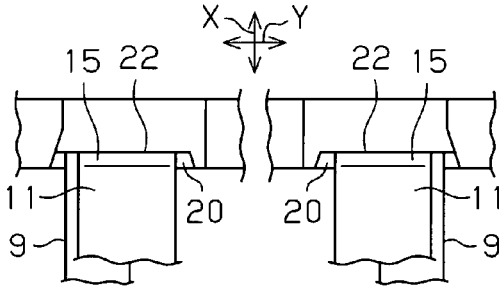
FIG. 5(*a*) is a plan view illustrating part of a support structure in which the razor head is supported by the support arms and part of a contact structure in which a pusher contacts the razor head.
Figure 5B:
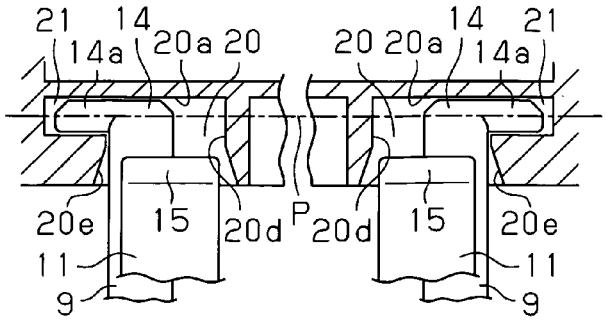
Figure 5C:
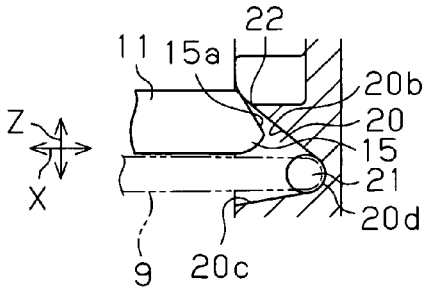

The recesses 20 each include a bottom 20*a*, a pair of wall surfaces 20*b* and 20*c*, which extend in the Z-axis direction facing each other, and a pair of wall surfaces 20*d*, 20*e*, which extend in the Y-axis direction facing each other, as shown in FIGS. 5(*a*) to 5(*c*). The wall surfaces 20*b*, 20*c* are tilted such that the distance between the wall surfaces 20*b*, 20*c* is increased as they separate from the bottom 20*a*. Thus, the cross-section of the recesses 20 along the Z-axis direction is V-shaped. A supported portion, which is a supported bore 21 in this embodiment, is formed in one of the wall surfaces 20*d*, 20*e* (the wall surface 20*e* in this case) to be adjacent to the bottom 20*a*. A contact portion 22 is formed in the end portion of one of the wall surfaces 20*b*, 20*c* (the wall surface 20*b* in this case). Each of the contact portions 22 may also be formed outward of the associated recess 20, which includes the supported bore 21, to be adjacent to the recess 20.

A shaving aid member 23 is arranged on the surface of the razor head 16 opposite to the guard 17*a*. The shaving aid member 23 includes a base member 25 and a shaving aid 24 arranged on the base member 25. The base member 25 includes an arm portion 26 on either end in the Y-axis direction. The arm portions 26 are each rotatably supported by a rotational center 27, which is formed on either end of the blade base 17 in the Y-axis direction.

Figure 4A:
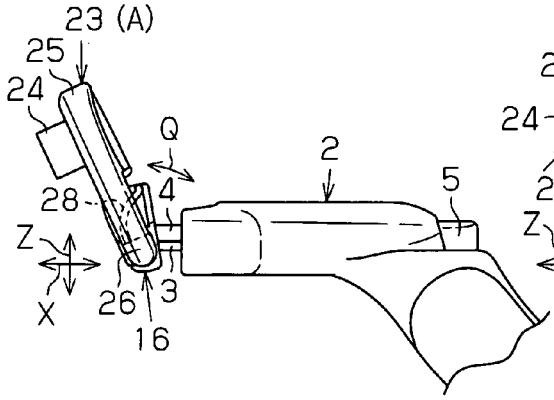
FIG. 4(*a*) is a side view illustrating a state where the shaving aid member of the razor head supported by the head portion of the holder is arranged at an initial position.
Figure 4B:
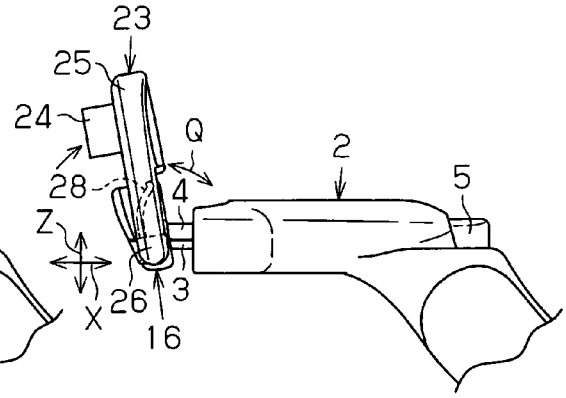

After the first outer arm portions 9 are inserted in the recesses 20 of the blade base 17 in a state where the support arms 3 are arranged at the standby position, at which the support arms 3 are located close to each other, the support arms 3 are brought into the support position. At this time, the razor head 16 is supported to be oscillatable with respect to the head portion 2 of the holder 1 as shown in FIG. 4(*a*). In this state, as shown in FIGS. 5(*a*) to 5(*c*), the shaft portions 14*a* of the hooked end portions 14 of the first outer arm portions 9 are inserted in the supported bores 21 of the recesses 20 and are placed on the bottoms 20*a* in the recesses 20 so that the razor head 16 is supported through the recesses 20.

Furthermore, the contact surfaces 15*a* of the contact end portions 15 on the second outer arm portions 11 of the pusher 4 are pressed against the contact portions 22 of the recesses 20. The razor head 16 is permitted to swing rearward, together with the shaving aid member 23, along an oscillating direction (in the direction of arrow Q in FIGS. 4(*a*) and 4(*b*)) about the rotational axis P, which passes through the shaft portions

14*a*. The oscillating angle of the razor head 16 is preferably 0 to 75 degrees, and is more preferably 0 to 60 degrees. As shown in FIGS. 4(*a*) and 4(*b*), the shaving aid member 23 swings from an initial position A, at which the shaving aid member 23 stops by being urged by leaf springs 28 formed in the arm portions 26 of the base member 25, with respect to the razor head 16 against the elastic force of the leaf springs 28 within a predetermined rotational range.

Also, if the first outer arm portions 9 are removed from the recesses 20 of the blade base 17 in a state where the support arms 3 are arranged in the standby position, at which the support arms 3 are located close to each other, the razor head 16 can be detached from the head portion 2 of the holder 1. The support arms 3 do not close immediately after the operating knob 5 is pressed. Instead, the support arms 3 move to the standby position after the operating knob 5 is depressed to prevent the razor head 16 from being detached from the head portion 2 of the holder 1 as the operating knob 5 is inadvertently pressed. As described above, even if the support arms 3 move between the standby position and the support position, the first outer arm portions 9 of the support arms 3 and the second outer arm portions 11 of the pusher 4 always slide with respect to each other while being adjacent to each other in the Z-axis direction.

The preferred embodiment may be modified as follows.

The head portion 2 of the holder 1, the support arms 3, and the pusher 4 may be integrally molded out of plastic. In this case, the support arms 3 and the pusher 4 are elastic.

The holder 1 may have a lock function to maintain the standby position of the support arms 3. In this case, when supporting the razor head 16 by the support arms 3, the pusher 4 is pressed by the razor head 16 so that the support arms 3 are unlocked and move to the support position.

The pusher 4 may be divided into left and right members, and each of the separated members may be provided with the second outer arm portion 11.

In the hooked end portions 14 of the support arms 3, the shaft portions 14*a*, which extend in the Y-axis direction, may protrude such that the shaft portions 14*a* face each other. Also, the supported bores 21 of the recesses 20 of the blade base 17 may be formed in the same direction as the shaft portions 14*a* of the hooked end portions 14. In this case, in the standby state at which the support arms 3 are separate from each other, the first outer arm portions 9 are inserted in the recesses 20 of the blade base 17. Then, when the support arms 3 approach each other and are arranged in the support position, the razor head 16 is supported to be oscillatable with respect to the head portion 2 of the holder 1.

The shaving aid member 23 may be omitted, and only the razor head 16 may be formed.

The oscillating razor of the preferred embodiment is mainly used for shaving hair on arms and legs but may be used for shaving facial hair.

The invention claimed is:

1. An oscillating razor comprising:

a holder including a head portion;

a razor head arranged on the head portion, and the razor head including a blade body with a cutting edge;

a pair of support arms arranged in the head portion, the support arms oscillatably support the razor head on both ends in the extending direction of the cutting edge of the blade body;

a pusher arranged in the head portion, the pusher being pressed against the razor head;

a pair of supported portions and a pair of contact portions formed in the razor head;

first distal end portions formed on the pair of support arms, the first distal end portions supporting the supported portions such that the razor head is rotatable along an oscillating direction; and a pair of second distal end portions formed on the pusher at positions corresponding to both ends in the extending direction of the cutting edge of the blade body, the second distal end portions being pressed against the contact portions, wherein at least part of each second distal end portion is arranged in a region extending through the associated first distal end portion in a direction perpendicular to a plane containing a contact direction of the pusher.

2. The oscillating razor according to claim 1, wherein the first distal end portions and the second distal end portions are arranged outward of the head portion of the holder, and are arranged next to each other at each end in the extending direction of the cutting edge of the blade body, and wherein a gap is defined between the first and the second distal end portions located at one of the ends in the extending direction of the cutting edge of the blade body and the first and second distal end portions located at the other end in the extending direction of the cutting edge of the blade body.

3. The oscillating razor according to claim 1, further comprising:

a pair of openings formed in the head portion of the holder;

a first outer arm portion formed in each of the support arms, the first outer arm portions protruding outward from the openings and configuring the first distal end portions; and a pair of second outer arm portions formed in the pusher, the second outer arm portions protruding outward from the openings and configuring the second distal end portions, wherein the support arms selectively open and close with respect to each other in the head portion of the holder, and wherein the pusher is movable in the head portion of the holder.

4. The oscillating razor according to claim 3, wherein each of the first outer arm portions and the associated second outer arm portion are arranged next to each other in a common one of the openings.

5. The oscillating razor according to claim 3, wherein the support arms are selectively arranged at a support position, at which the support arms support the razor head, and a standby position, at which the support arms stand ready to support the razor head, wherein, when the support arms are at the standby position, the end portion of the first outer arm portion of each support arm protrudes forward than the end portion of the associated second outer arm portion of the pusher in the contact direction of the pusher.

6. The oscillating razor according to claim 1, wherein at each end of the razor head in the extending direction of the cutting edge of the blade body, the supported portion, which is supported by the associated first distal end portion, and the contact portion, to which the associated second distal end portion is pressed against, are arranged adjacent to each other.

7. The oscillating razor according to claim 1, wherein the second distal end portions are slidable with respect to the first distal end portions.

8. The oscillating razor according to claim 1, further comprising:

an assembly member arranged in the razor head, the assembly member including a guard, wherein the blade body is mounted on the assembly member, wherein the cutting edge of the blade body faces the guard, and wherein the second distal end portions of the pusher are arranged over the first distal end portions of the support arms in a direction perpendicular to a plane containing the contact direction of the pusher.

* * * * *